United States Patent [19]

Washizu et al.

[11] Patent Number: 5,007,267

[45] Date of Patent: Apr. 16, 1991

[54] METHOD AND APPARATUS FOR MANUFACTURING BELLOWS PIPE

[75] Inventors: Katsushi Washizu, Numazu; Mitsumasa Ohtaka, Okazaki, both of Japan

[73] Assignee: Usui Kokusai Sangyo Kaisha Limited, Japan

[21] Appl. No.: 478,140

[22] Filed: Feb. 9, 1990

[30] Foreign Application Priority Data

Feb. 14, 1989 [JP] Japan ..... 1-34096

[51] Int. Cl.[5] ..... B21D 15/10

[52] U.S. Cl. ..... 72/59; 72/57; 72/61

[58] Field of Search ..... 72/57, 58, 59, 61; 29/421.1

[56] References Cited

U.S. PATENT DOCUMENTS

| | | | |
|---|---|---|---|
| 2,581,787 | 1/1952 | Dreyer | 72/59 |
| 2,954,064 | 9/1960 | De Mers | 72/59 |
| 3,083,754 | 4/1963 | De Mers | 72/59 |
| 3,130,771 | 4/1964 | Peyton | 72/59 |
| 3,339,386 | 9/1967 | Homfeldt | 72/59 |
| 3,375,689 | 4/1968 | Millar | 72/59 |
| 4,364,252 | 12/1982 | Koizumi | 72/59 |

FOREIGN PATENT DOCUMENTS

| | | | |
|---|---|---|---|
| 0532335 | 10/1956 | Canada | 72/59 |

*Primary Examiner*—David Jones

*Attorney, Agent, or Firm*—Anthony J. Casella; Gerald E. Hespos

[57] ABSTRACT

A bellows pipe is manufactured from a raw pipe, with an elastic body pinched between a movable core and a fixed core inside the raw pipe, by compressing the elastic body by axially moving the movable core to form an annular convex portion in the raw pipe, changing the annular convex portion to a bellows portion by axially moving a punch to press the annular convex portion, pinching the bellows portion between a chuck and a chuck inner block assembled therein, shifting the pipe a given distance by axially moving the chuck and chuck inner block holding the bellows portion therebetween, and repeating the foregoing steps. Therefore, a small-diameter raw pipe of smaller than 16 mm diameter can be deformed, the outer diameter, pitch, etc. of a bellows portion can be freely set, the elastic body is worn little.

10 Claims, 4 Drawing Sheets

METHOD AND APPARATUS FOR MANUFACTURING BELLOWS PIPE

BACKGROUND OF THE INVENTION

1. Field of the Invention

This invention relates to a method and apparatus for manufacturing a bellows pipe, particularly of small diameter.

2. Description of the Prior Art

In the field of a method and apparatus for manufacturing a bellows pipe, there are known Japanese Patent Publication No. 44-24746 (Bulge machining apparatus), Japanese Patent Laid-Open No. 59-133021 (Method and apparatus for manufacturing corded pipe), Japanese Patent Laid-Open No. 63-207421 (Method and apparatus for manufacturing beaded pipe), etc.

Among them, according to Japanese Patent Publication No. 44-24746, a desired bellows portion is formed in one step by expanding a bead portion using an inner pressure and concurrently causing axial compression using a mold.

According to Japanese Patent Laid-Open No. 59-133021, two core rods with an elastic body interposed therebetween are inserted into a pipe, one core rod is pushed toward the other to deform the elastic body, thereby forming an expanded angle portion in a portion of the pipe, and this expanded portion is shaped so as to conform to a bending mold, whereby a corded pipe is manufactured.

According to Japanese Patent Laid-Open No. 63-207421, a pressure medium is disposed inside a work to apply an inner pressure thereto, mold elements together defining a bead forming recess thereinside are disposed outside the work relatively movably in the axial direction of the work, the work is subjected to plastic deformation so that it is expanded, and the mold elements are caused to approach each other, whereby a beaded pipe is manufactured.

Among the foregoing systems hitherto proposed, in the system of Japanese Patent Publication No. 44-24746, the mold must be prepared so as to meet the length of a pipe and the number of beads of a bellows portion; thus, the machinable pipe length is limited and the mold is expensive.

In the two systems of Japanese Patent Laid-Open Nos. 59-133021 and 63-207421, although the degree of freedom relating to the number of beads in a bellows portion is comparatively large, since the elastic body is disposed as passing through the core, it is difficult to decrease the diameter of the core portion in view of the purpose of ensuring the strength of the core and the volume of the elastic body; thus, the minimum deformable diameter of a pipe is of the order of 16mm.

Further, since a bead forming groove is provided in the mold, the outer diameter and pitch of a bead are limited and the degree of freedom of bead shape is limited. Since a pipe is secured by the mold at two points between which an expanded portion is to be formed, the pipe cannot shift in the axial direction sufficiently during expansion; thus, a top portion of the bead becomes thin, and the elastic body is severely worn because of forced sliding. Further, since the elastic body is caused to expand itself inside the mold, a large tightening force is required for the mold; thus, the elastic body is easily worn because of an unreasonable force being applied.

Furthermore, during successive forming of a bellows portion, the elastic body is compressed by the bellows portion and its edge portion is pinched between the bellows portions; thus, the elastic body is severely worn.

In addition, in the system of Japanese Patent Laid-Open No. 63-207421, since an expanded portion together with the elastic body is compressed in the axial direction, the elastic body tends to be torn off.

SUMMARY OF THE INVENTION

It is an object of the present invention to provide a method and apparatus for manufacturing a bellows pipe, particularly of small diameter, which is capable of deforming a small-diameter pipe of smaller than 16mm diameter, freely setting the outer diameter, pitch, etc. of a bellows portion, and remarkably reducing the wearing of an elastic body.

To accomplish the foregoing object, the present invention provides a bellows pipe manufacturing method which comprises, with an elastic body pinched between a movable core and a fixed core inside a raw pipe to be deformed, the first step of compressing the elastic body in the axial direction of the pipe to resiliently expand the elastic body radially of the pipe such that a peripheral portion of the pipe changes to an annular convex portion, the second step of changing the annular convex portion to a bellows portion using a forming and holding means, and the third step of pinching the bellows portion and shifting the pipe to a given position using the forming and holding means, wherein the first through third steps are repeated with respect to the pipe shifted to the given position to successively form bellows portions at given intervals in the pipe.

Further, the present invention provides a bellows pipe manufacturing apparatus which comprises a movable core movable in the axial direction thereof on which a raw pipe is to be loosely fitted, a first driving means for moving the movable core in the axial direction, a fixed core disposed in alignment with the movable core, an elastic body pinched between the movable core and the fixed core inside the pipe, a forming and holding means for changing an annular convex portion, formed in a peripheral portion of the pipe by actuating the first driving means to cause the elastic body to expand radially of the pipe, to a bellows portion and holding the thus formed bellows portion, and a second driving means for moving the forming and holding means with the bellows portion held thereby to shift the pipe.

In brief, according to the present invention, the elastic body is pinched between the movable core and the fixed core inside a raw pipe to be deformed. In this state, the first driving means is actuated to expand the elastic body radially of the pipe so that an annular convex portion is formed in the pipe (the first step).

The second driving means is actuated to change the annular convex portion to a bellows portion using the forming and holding means (the second step), the thus formed bellows portion is pinched by the forming and holding means, and the pipe is shifted to a given position (the third step).

The first through third steps are repeated with respect to the pipe shifted to the given position; as a result, a plurality of bellows portions are formed successively at given intervals in the pipe.

DETAILED DESCRIPTION OF THE PREFERRED EMBODIMENTS

The present invention will now be described in greater detail with reference to the drawings.

Figure 1:
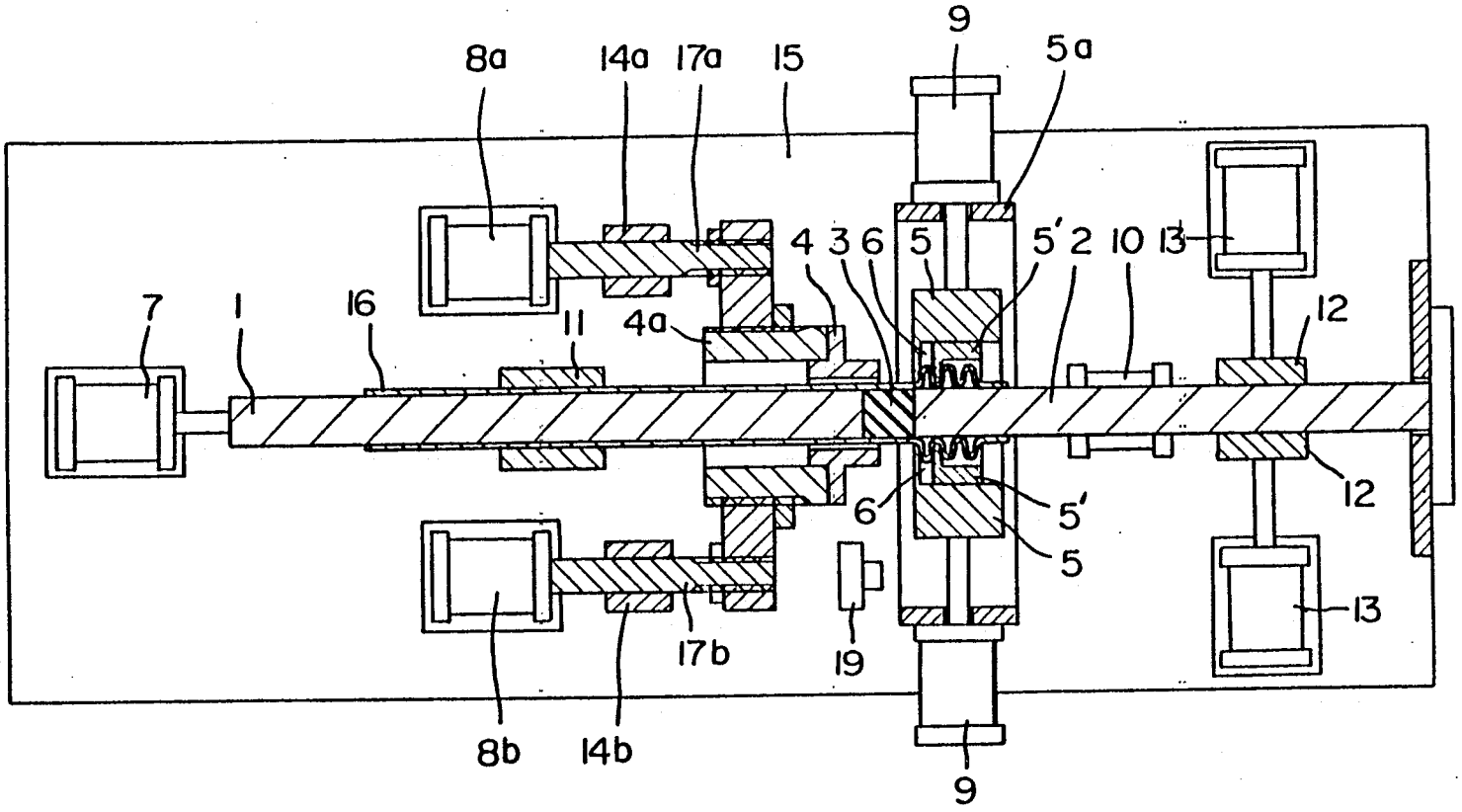
FIG. 1 is a plan view, partly in cross section, showing an embodiment of an apparatus according to the present invention.
Figure 2:
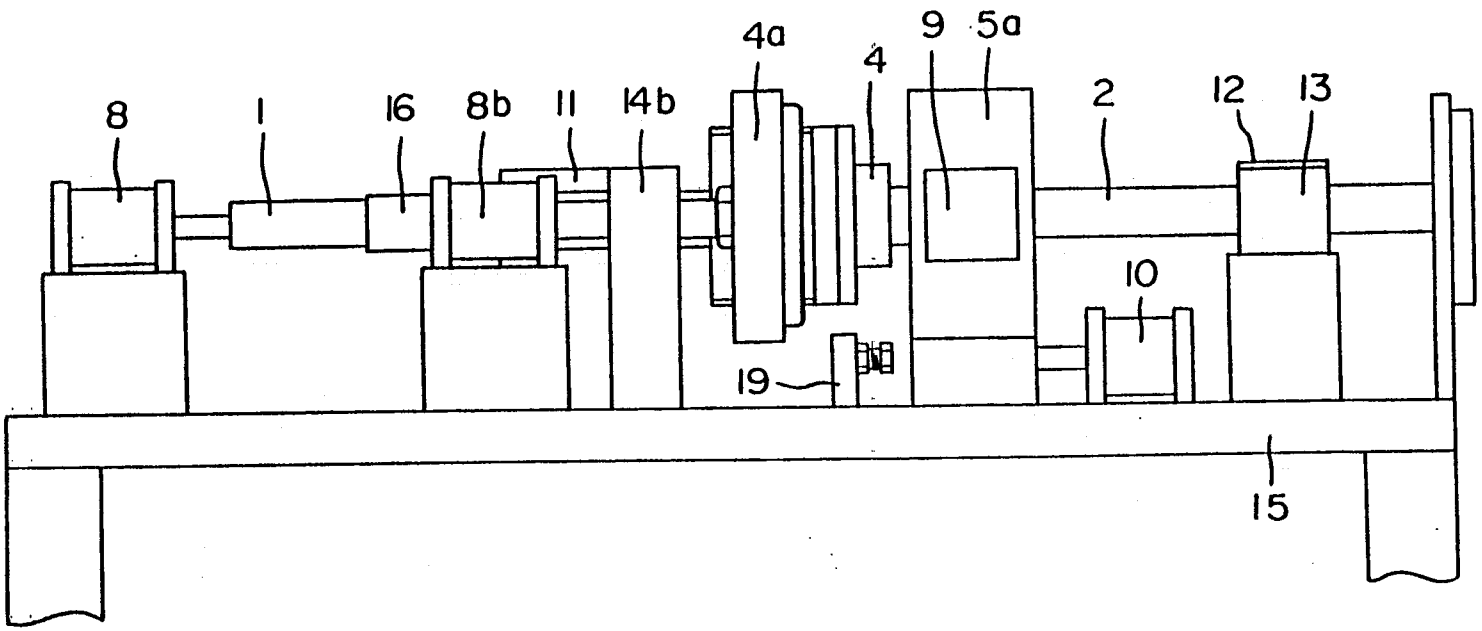
FIG. 2 is a front view corresponding to FIG. 1.

In FIGS. 1 and 2 showing an embodiment of an apparatus according to the present invention, a core driving cylinder 7 is secured on a base 15, and a movable core 1 is supported over the base 15, which is moved in the axial direction thereof by the core driving cylinder 7 and on which a raw pipe 16 to be deformed is loosely fitted.

An elastic body 3 made of urethane rubber is disposed inside the pipe 16 and between the movable core 1 and a fixed core 2 arranged coaxially thereto.

A fixed guide 11 for guiding the holding the movable core 1 and the pipe 16 loosely fitted thereon is secured on the base 15 at about a central position of the movable core 1 to prevent flexure of the pipe 16 and the movable core 1. Movable guide operating cylinders 13 are secured on the base 15 in the vicinity of the fixed core 2, to which movable guides 12 are attached that are adapted to stationarily pinch the fixed core 2 (and the pipe 16 when it exists) to prevent flexure of the fixed core 2 during deforming.

A punch 4 whose inner diameter is slightly larger than the outer diameter of the pipe 16 is supported by a punch holder 4*a* movably along the pipe 16. Rods 17*a* and 17*b* guided by shaft guides 14*a* and 14*b* are screw-locked to the punch holder 4*a*, and driven parallel to the movable core 1 by punch driving cylinders 8*a*and 8*b* so that the punch 4 can move along the pipe 16.

A chuck holder 5*a* is disposed between the punch 4 and the movable guides 12, and moved along the pipe 16 by a chuck shifting cylinder 10. A front stopper 19 for the chuck holder 5*a* is secured in the vicinity of the punch holder 4*a*.

the chuck holder 5*a* supports a chuck 5 and a chuck inner block 5' assembled therein, and the gap 6 between the chuck 5 and the chuck inner block 5' can be regulated to a desired width. The chuck 5 and the chuck inner block 5' can be moved toward the away from the pipe 16 by chuck operating cylinders 9 secured to the chuck holder 5*a*.

An embodiment of a method according to the present invention will be described with reference to FIGS. 3 through 11.

Figure 3:
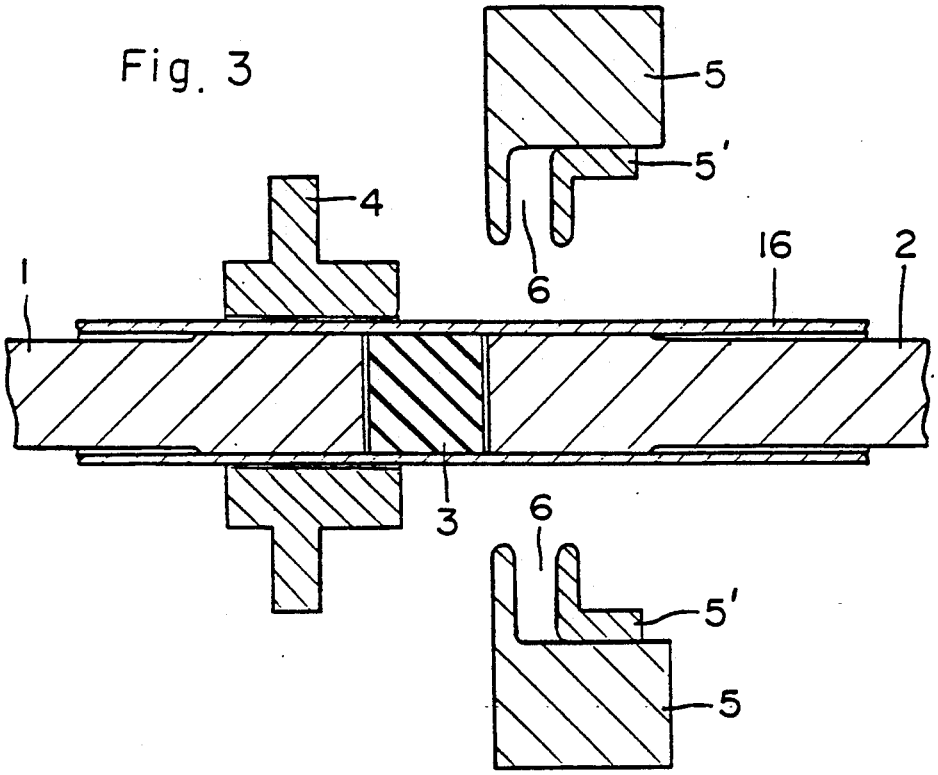
FIGS. 3 through 11 are schematic diagrams showing the manufacturing process of the embodiment.

In FIG. 3 showing the step of attaching the pipe 16 to be deformed, the pipe 16 is loosely fitted on the movable core 1, the elastic body 3 is inserted into the pipe 16 so that its one end comes to contact with the distal end of the movable core 1, and the fixed core 2 is inserted into the pipe 16 so that the elastic body 3 is pinched between the two cores.

Here, the gap 6 between the chuck 5 and the chuck inner block 5' is previously set to a given width, the chuck 5 and the chuck inner block 5' are sufficiently spaced apart from the pipe 16 by the actuation of the chuck operating cylinders 9 shown in FIG. 1, and a deforming end portion of the chuck 5 is positioned in the vicinity of the interface between the elastic body 3 and the fixed core 2.

Further, the movable guide operating cylinders 13 shown in FIG. 1 are actuated so that the fixed core 2 is stationarily secured with respect to the base 15 by the movable guides 12 for later deforming.

Figure 4:
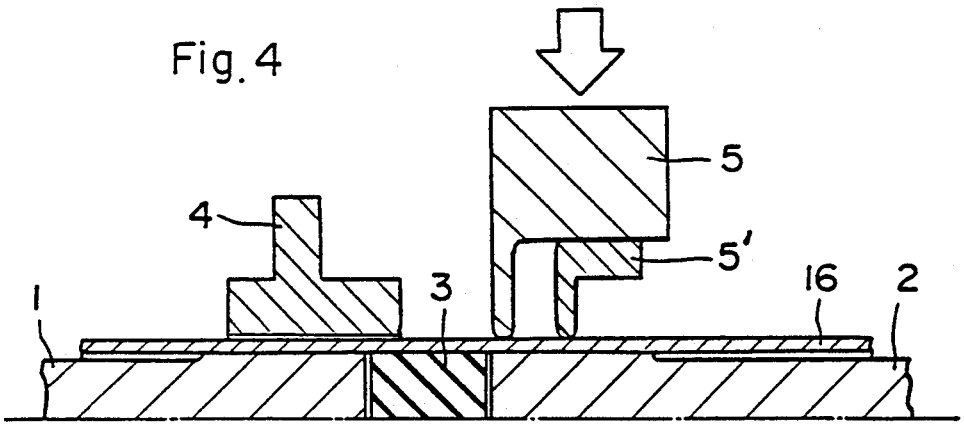

In FIG. 4 showing the step of holding down, the chuck operating cylinders 9 are actuated so that the points of the chuck 5 and the chuck inner block 5' come to contact with the outer periphery of the pipe 16, thereby holding it stationary.

Figure 5:
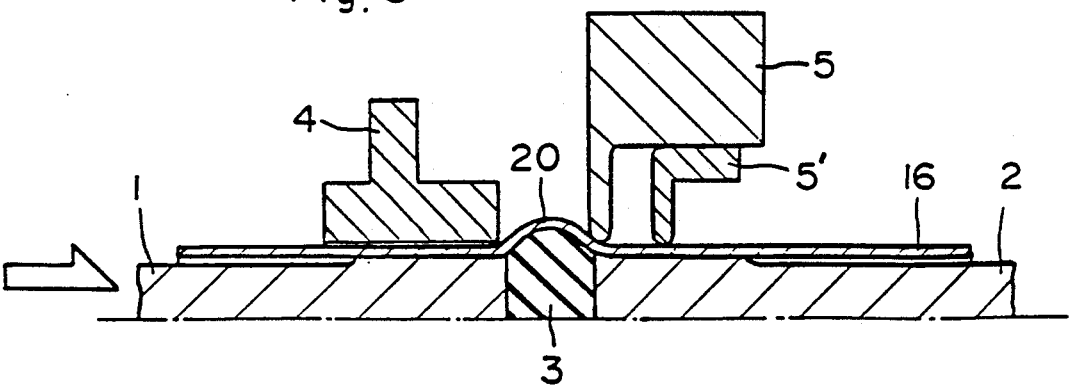
Figure 6:
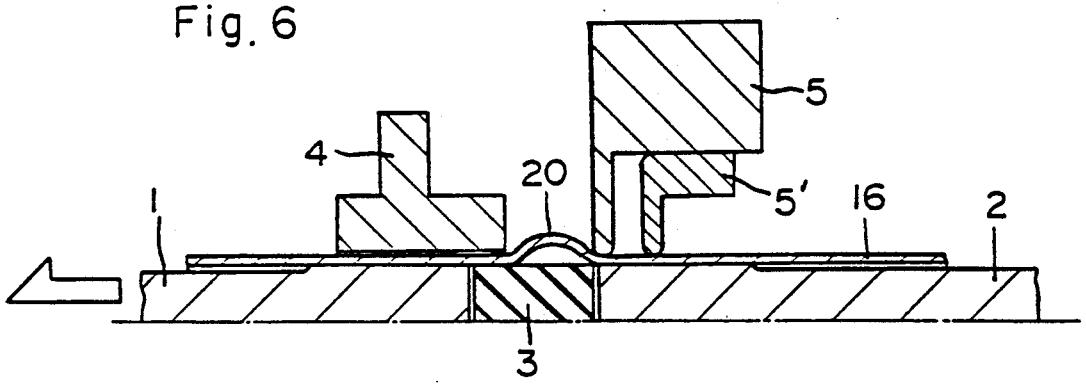

In FIGS. 5 and 6 showing the (first) step of forming an annular convex portion, an annular convex portion 20 is formed in the pipe 16. That is, under the condition that the pipe 16 is held stationary by the points of the chuck 5 and the chuck inner block 5' as shown in FIG. 5, the core driving cylinder 7 is actuated so that the elastic body 3 is compressed and radially expanded by the movable core 1, whereby the annular convex portion 20 is formed in the pipe 16 through radial expansion.

After the annular convex portion 20 is formed by moving the movable core 1 a given distance to cause elastic expansion of the elastic body 3 as described above, as shown in FIG 6, the core driving cylinder 7 is actuated to move the movable core 1 away from the chuck holder 5*a* to its initial position, so that the elastic body 3 recovers its original shape.

Figure 7:
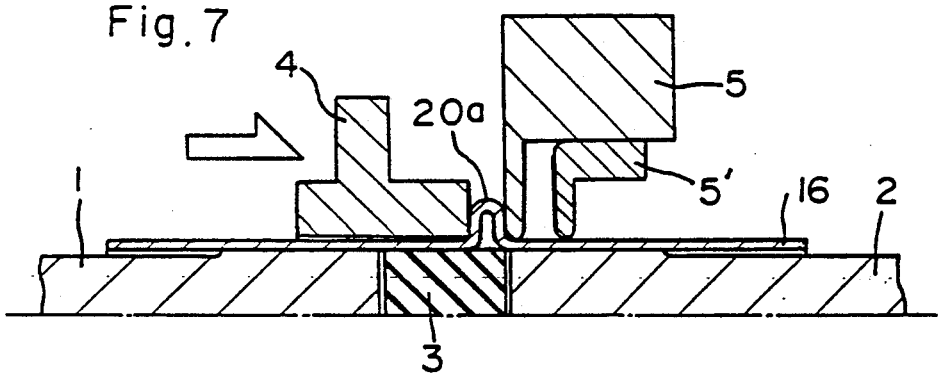
Figure 8:
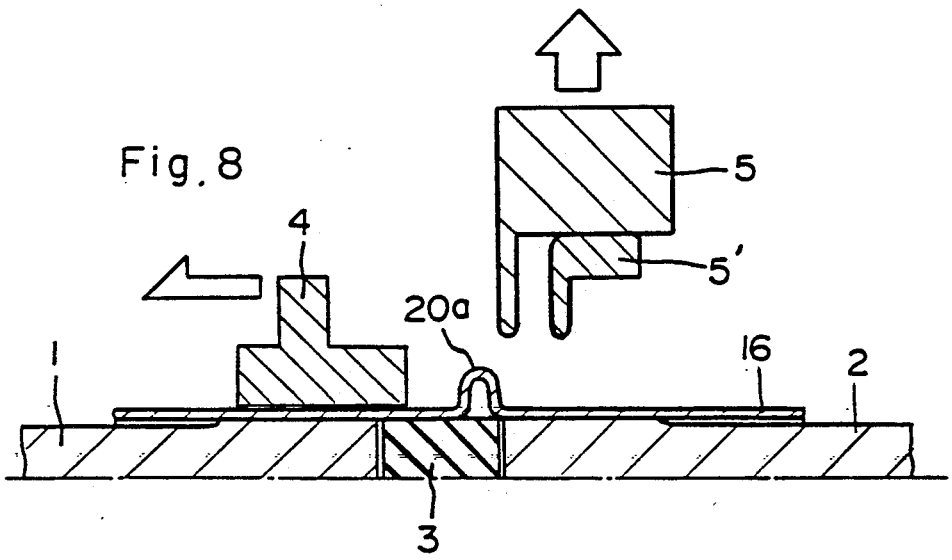

In FIGS. 7 and 8 showing the (second) step of forming a bellows portion, the annular convex portion 20 formed in the pipe 16 in the first step is changed to a bellows portion 20*a*. That is, under the condition that the pipe 16 is held down by the chuck 5 and the chuck inner block 5', as shown in FIG. 7, the punch driving cylinders 8*a* and 8*b* are actuated to move the punch 4 a given distance toward the chuck holder 5*a* by the rods 17*a* and 17*b* so that the annular convex portion 20 is pinched and pressed between the opposing faces of the punch 4 and the chuck 5, whereby the bellows portion 20*a* is formed. Here, the finished width of the bellows portion 20*a* is slightly smaller than the width of the gap 6 between the chuck 5 and the chuck inner block 5'.

After the bellows portion 20*a* is formed in the pipe 16, as shown in FIG. 8, the punch driving cylinders 8*a* and 8*b* are actuated to return the punch 4 to its initial position, and the chuck operating cylinders 9 are actuated to move the chuck 5 and the chuck inner block 5' away from the pipe 16.

Figure 9:
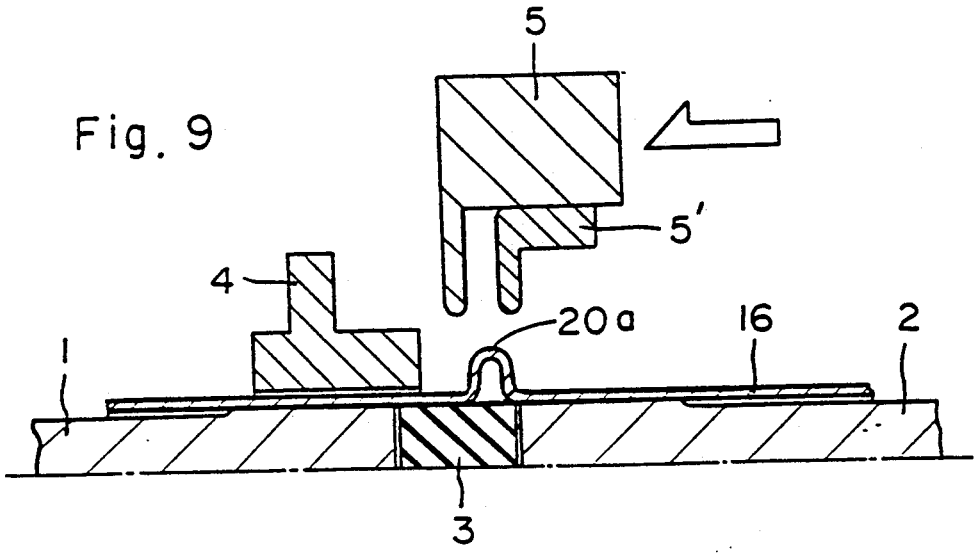
Figure 10:
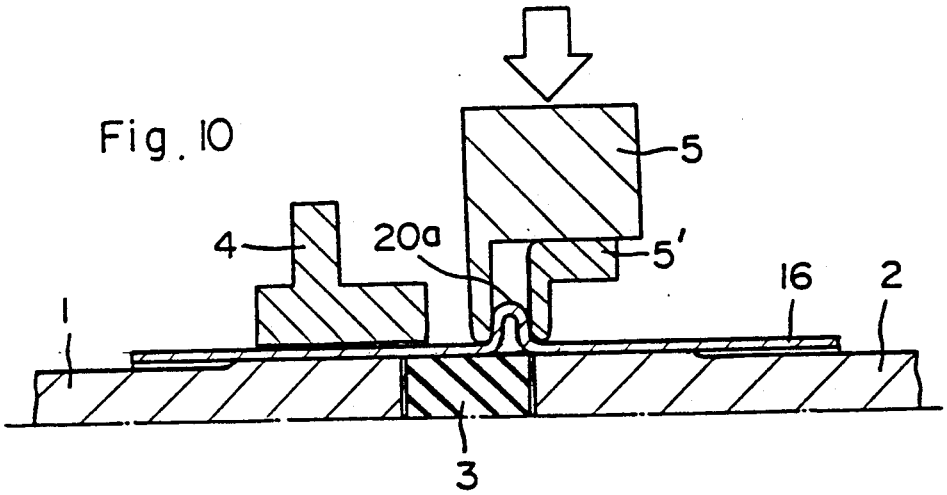
Figure 11:
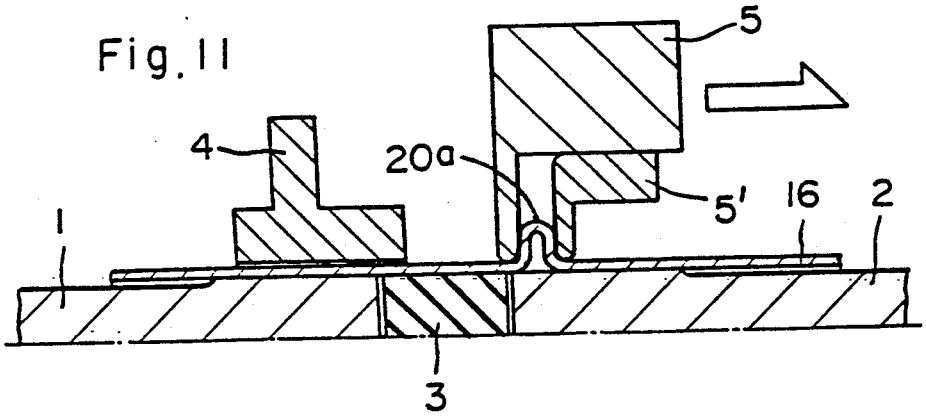

In FIGS. 9 through 11 showing the (third) step of shifting, the pipe 16 with the bellows portion 20*a* formed therein in the second step is shifted to the position where a next bellows portion should be formed. That is, as shown in FIG. 9, the chuck shifting cylinder 10 is actuated to move the chuck holder 5*a* so that the gap 6 between the chuck 5 and the chuck inner block 5' comes to a position over the bellows portion 20*a* formed in the second step.

Then, the chuck operating cylinders 9 are actuated to move the chuck 5 and the chuck inner block 5' toward the pipe 16 so that the bellows portion 20*a* is held by the gap 6 as shown in FIG. 10. When the front end of the pipe 16 formed with the bellows portion comes close to the movable guide 12, the movable guide operating cylinders 13 are actuated to release the tightened state of the fixed core 2 by the movable guide 12, and the chuck shifting cylinder 10 is actuated to move the chuck 5 and the chuck inner block 5' so that the end portion of the chuck 5 comes into alignment with the interface between the elastic body 3 and the fixed core 2; as a result, the pipe 16 is shifted on and along the movable core 1 and the fixed core 2. Of course, the movable guide 12 is caused to come into pressure contact with the outer periphery of a non-deformed portion or the bellows portion formed of the pipe 16, so tht the flexure of the fixed core 2 and the pipe 16 if prevented in later deforming.

Then, the first through third steps are repeated with respect to a non-deformed portion of the pipe 16 located between the punch 4 and the chuck 5 to form another bellows portion adjacent to the bellows portion 20*a*. In this way, the repetition of the foregoing steps changes the pipe 16 to a bellows pipe.

After the bellows pipe is completed, the cylinders 13 are actuated to remove the movable guide 12, the fixed core 2 is detached, and the bellows pipe is taken out of the apparatus.

In the embodiment of the present invention, the elastic body 3 is compressed by the movable core 1 and the fixed core 2 with the pipe 16 serving as a guide; thus, the cores can have a very small diameter. Since the pipe 16 and the core 1 are supported by the fixed guide 11 and the movable guide 12 and their flexure is suppressed, it is possible to manufacture a small-diameter bellows pipe of smaller than 16 mm diameter. Of course, a large-diameter bellows pipe can be manufactured equally.

Since the deforming is performed under the condition that the end face of the fixed core 2 is in substantial alignment with the end of the chuck 5, no part of the elastic body 3 expands into the chuck 5 and the chuck inner block 5', the chuck 5 and the chuck inner block 5' require no strong tightening force, and there is no damage to the elastic body 3.

Since the shifting of the pipe 16 is free on the side of the movable core 1, the pipe 16 can shift smoothly in the first and second steps, the thickness of the pipe decreases little, the sliding between the pipe and the elastic body 3 is smooth, and the service life of the elastic body 3 elongates.

Since the punch 4, chuck 5 and chuck inner bloc 5' have no groove defining the shape of the bellows portion, it is possible to arbitrarily set the outer diameter, pitch, etc. of the bellows portion by regulating the spacing between the punch 4 and the chuck 5, the stroke of the punch 4, and the like; and no part of the elastic body is caught in the gap of the bellows portion even during successive forming of the bellows portion.

Although the embodiment uses the cylinders as actuators for driving the movable core, punch, chuck and chuck inner block, the present invention shold not be limited to the embodment described. These components may be driven by pulleys to which the rotational force of a motor is transmitted.

Although not included in the embodiment, a jig for defining the initial position of deforming of the pipe may be provided on the base, and several fixed guides and movable guides may be provided depending on the length of the movable core and of the fixed core.

As described in greater detail, according to the method and apparatus of the present invention, a decrease in thickness of the pipe during deforming can be limited to a minimum, damage to the elastic body is prevented, various bellows shapes can be readily set, and small-diameter bellows pipes as well as large-diameter bellows pipes can be manufactured efficiently.

What is claimed is:

1. A bellows pipe manufacturing method for forming a bellows pipe having opposed first and second ends comprising, providing a solid fixed core, a solid movable core and a solid elastic body all of which are dimensioned to be inserted into the pipe, slidably moving the first end of the pipe over the solid fixed core, inserting the solid elastic member into the second end of the pipe and into contact with the fixed core, inserting the solid movable core into the second end of the pipe and into contact with the elastic member, moving the solid movable core toward the solid fixed core for compressing the elastic body in an axial direction of the pipe to resiliently expand the elastic body radially of the pipe such that a peripheral portion of the pipe changes to an annular convex portion, moving the solid movable core away from the solid fixed core for permitting the elastic body to resiliently return to an unexpanded condition, changing the annular convex portion to a bellows portion using a forming and holding means external of the pipe, and pinching the bellows portion on opposed sides thereof and shifting the pipe to a selected position using the forming and holding means, wherein the steps from the step of moving the movable core toward the fixed core are repeated with respect to the pipe shifted to the selected position to successively form bellows portions at selected intervals in the pipe.

2. A bellows pipe manufacturing method according to claim 1, wherein the forming and holding means comprises a punch movable along the pipe and a chuck movable along the pipe and approachable thereto.

3. A bellows pipe manufacturing method according to claim 2, wherein in the step of changing the annular convex portion to a bellows portion, the chuck is held stationary in contact with the pipe, and with the annular convex portion being pinched between the chuck and the punch, the punch being axially moved to press and change the annular convex portion to the bellows portion.

4. A bellows manufacturing method according to claim 1, wherein in the step of pinching the bellows portion and shifting the pipe further comprises the steps of, providing a chuck and a chuck inner block assembled together and defining a gap therebetween, moving the chuck and the chuck inner block to approach the pipe for holding the bellows portion in the gap and moving the chuck and the chuck inner block in unison to axially shift the pipe.

5. A bellows pipe manufacturing apparatus for deforming a pipe having opposed first and second ends into a bellows pipe, comprising:

a solid elongated movable core movable in the axial direction thereof and dimensioned to be loosely fitted in the first end of the pipe, a first driving means for moving the movable core in the axial direction alternately toward and away from the second end of the pipe, a solid elongated fixed core disposed in axial alignment with the movable core and dimensioned to be loosely fitted inside the second end of the pipe, a solid elastic body dimensioned, in an unbiased condition, to be loosely fitted inside the pipe between the movable core and the fixed core such that movement of the movable core toward the fixed core pinches the elastic body therebetween and expands the elastic body outwardly for defining an annular convex portion in the pipe, and such that movement of the movable core away from the fixed core permits the elastic body to resiliently return to an unexpanded condition, a forming and holding means for changing the annular convex portion to a bellows portion and holding the thus formed bellows portion, and a second driving means for moving the forming and holding means with the bellows portion held thereby to shift the pipe.

6. A bellows pipe manufacturing apparatus according to claim 5, wherein each of the driving means is a cylinder.

7. A bellows pipe manufacturing apparatus according to claim 5, wherein the forming means comprises a punch movable axially along the pipe and a chuck movable axially along the pipe and further being movable radially alternately toward and away from the pipe.

8. A bellows pipe manufacturing apparatus according to claim 7, wherein the holding means further comprises a chuck inner block assembled in proximity to the chuck to define a gap of a selected size, the second driving means comprising means for simultaneously moving the punch axially away from the bellows and simultaneously moving the chuck and chuck inner block radially and axially to pinch the bellows in the gap between the chuck and the chuck inner block, said second driving means further comprising means for subsequently moving the chuck and the chuck inner block axially for shifting the pipe into a position for forming a subsequent bellows portion.

9. A bellows pipe manufacturing apparatus according to claim 5, further including a fixed guide for guiding the movable core and the pipe loosely fitted thereon.

10. A bellows pipe manufacturing apparatus according to claim 5, further including a movable guide for stationarily holding at least the fixed core.

* * * * *